US011466369B2

(12) United States Patent
Han et al.

(10) Patent No.: US 11,466,369 B2
(45) Date of Patent: Oct. 11, 2022

(54) ELECTROLESS PLATING SOLUTION AND ELECTROLESS PLATING METHOD FOR RECOVERING PRECIOUS METAL ADSORBED ON POROUS PORPHYRIN POLYMER

(71) Applicant: KOREA ADVANCED INSTITUTE OF SCIENCE AND TECHNOLOGY, Daejeon (KR)

(72) Inventors: Jong-In Han, Daejeon (KR); Jieun Son, Daejeon (KR); Cafer Yavuz, Daejeon (KR); Youngran Hong, Daejeon (KR)

(73) Assignee: KOREA ADVANCED INSTITUTE OF SCIENCE AND TECHNOLOGY, Daejeon (KR)

( * ) Notice: Subject to any disclaimer, the term of this patent is extended or adjusted under 35 U.S.C. 154(b) by 0 days.

(21) Appl. No.: 17/413,559

(22) PCT Filed: Nov. 29, 2019

(86) PCT No.: PCT/KR2019/016679
§ 371 (c)(1),
(2) Date: Jun. 13, 2021

(87) PCT Pub. No.: WO2020/122479
PCT Pub. Date: Jun. 18, 2020

(65) Prior Publication Data

US 2022/0056591 A1 Feb. 24, 2022

(30) Foreign Application Priority Data

Dec. 14, 2018 (KR) ..... 10-2018-0162181

(51) Int. Cl.
*C23C 18/42* (2006.01)
*C23C 18/16* (2006.01)

(52) U.S. Cl.
CPC ..... *C23C 18/42* (2013.01); *C23C 18/1637* (2013.01)

(58) Field of Classification Search
CPC ..... C08G 61/124; C08G 61/122; C08G 2261/3241; C08G 2261/3321;
(Continued)

(56) References Cited

U.S. PATENT DOCUMENTS

2003/0054094 A1* 3/2003 Itabashi ..... C23C 18/1653 427/404
2006/0246699 A1* 11/2006 Weidman ..... H01L 21/76831 257/E21.174
(Continued)

FOREIGN PATENT DOCUMENTS

JP 19308761 A 11/2007
KR 1019910006643 B1 8/1991
(Continued)

OTHER PUBLICATIONS

Bettelheim, A., et al., "Electrochemical Polymerization of Amino-, Pyrrole-, and Hydroxy-Substituted Tetraphenylporphyrins", Inorg. Chem., 1987, pp. 1009-1017, vol. 26, Publisher: American Chemical Society.
(Continued)

*Primary Examiner* — Dah-Wei D. Yuan
*Assistant Examiner* — Nga Leung V Law
(74) *Attorney, Agent, or Firm* — Hultquist, PLLC; Steven J. Hultquist

(57) ABSTRACT

The present invention relates to a method for recovering a precious metal selectively adsorbed on a porous porphyrin polymer, and to an electroless plating method capable of recovering a precious metal in a film form by desorbing and leaching the precious metal without an additional oxidizing agent and using same as a plating solution to reduce the
(Continued)

precious metal on the surface of a substrate without an additional reducing agent.

9 Claims, 4 Drawing Sheets

(58) Field of Classification Search
CPC ..... B01J 20/226; B01J 20/28061; B01J 20/28066; B01J 20/28083; B01J 20/305; B01J 2220/50; C02F 1/285; C02F 2103/08; C02F 2103/16; C02F 2103/346
See application file for complete search history.

(56) References Cited

U.S. PATENT DOCUMENTS

2009/0056994 A1* 3/2009 Kuhr ..... H05K 3/389 118/58
2019/0024239 A1* 1/2019 Dammasch ..... H01L 21/76873

FOREIGN PATENT DOCUMENTS

KR 101366183 B1 2/2014
KR 1020160046172 A 4/2016
KR 1020190070257 A 6/2019
WO 2017111092 A1 6/2017

OTHER PUBLICATIONS

Pyrzynska, K., "Sorbent materials for separation and preconcentration of gold in environmental and geological samples—A review", Analytica Chimica Acta, 2012, pp. 9-14, vol. 741, Publisher: Elsevier.

Ramesh, A., et al., "Adsorption of gold (III), platinum (IV) and palladium (II) onto glycine modified crosslinked chitosan resin", Bioresource Technology, 2008, pp. 3801-3809, vol. 99, Publisher: Elsevier.

Tofan, L., et al., "Synthesis, characterization and experimental assessment of a novel functionalized macroporous acrylic copolymer for gold separation from wastewater", Process Safety and Environmental Protection, 2017, pp. 150-162, vol. 106, Publisher: Elsevier.

Yuasa, M., et al., "Micellar Cobaitporphyrin Nanorods in Alcohols", J. Am. Chem. Soc., 2004, pp. 11128-11129, vol. 126, Publisher: JACS Communications.

* cited by examiner

ELECTROLESS PLATING SOLUTION AND ELECTROLESS PLATING METHOD FOR RECOVERING PRECIOUS METAL ADSORBED ON POROUS PORPHYRIN POLYMER

CROSS-REFERENCE TO RELATED APPLICATIONS

This is a U.S. national phase under the provisions of 35 USC § 371 of International Patent Application No. PCT/KR19/16679 filed Nov. 29, 2019, which in turn claims priority under 35 USC § 119 of Korean Patent Application No. 10-2018-0162181 filed Dec. 14, 2018. The disclosures of such applications are hereby incorporated herein by reference in their respective entireties, for all purposes.

TECHNICAL FIELD

The present invention relates to an electroless plating solution and an electroless plating method for recovering a precious metal adsorbed on a porous porphyrin polymer, and more particularly, to an electroless plating solution for recovering a precious metal adsorbed on a porous porphyrin polymer, the electroless plating solution containing the porous porphyrin polymer having high selectivity for the precious metal element, and an electroless plating method using the same.

BACKGROUND ART

The recent development of the electric and electronic industry has brought about a rapid increase in e-waste containing precious metals and interest in the development of technologies for recovering such precious metal with high economic value. In addition, since the wastewater discharged during the plating process or the electronic industry process contains significant amounts of precious metals, there is a need for development of a technology for recovering the precious metals. However, the development of technologies associated with precious metals in wastewater has been focused on removal thereof in order to satisfy the standards for water pollutant discharge.

Methods of recovering precious metals from electronic industrial waste may be divided into dry smelting using melting, wet smelting using leaching, and biological smelting, which is an adsorption smelting method using microorganisms. Among them, solutions and industrial wastewater generated through wet smelting contain various types of precious metals, and research to selectively separate and recover various types of precious metals has been conducted to date. Adsorbents using silica, polymers, activated carbon, microorganisms etc. have been utilized to selectively recover metals (Pyzynsk, Analytica Chimica Acta 741 (2012): 9-14).

However, regarding the method of selectively recovering precious metals using adsorbents, the development for methods for the subsequent utilization of the recovered precious metals is insufficient. In particular, technologies for utilizing the precious metals after desorption of the precious metals, for reuse of adsorbents, or technologies considering the effects of such desorption on adsorbents should be implemented effectively in consideration of the characteristics of respective adsorbents. However, regarding precious metal adsorbents developed to date, the technology for the desorption method for reuse is disclosed, but the development for technology to utilize the desorption solution is insufficient (Ramesh et al., *Bioresource Technology* 88 (2008): 3801-3809, Tofan et al., *Process Safety and Environmental Protection* 106 (2017): 150-162).

Accordingly, as a result of extensive efforts to solve the problems, the present inventors found that, when an electrolyte containing a porous porphyrin polymer of Formula 1 capable of selectively adsorbing precious metals disclosed in Korean Patent Application No. 10-2017-0170184 filed by the present inventors is used for an electroless plating method, precious metals selectively adsorbed on the polymer can be recovered at an improved reduction efficiency using a non-cyanide bath without adding highly toxic cyanide as well as an additional desorption oxidizing agent and plating reducing agent, and the polymer can be reused even after desorption of the precious metal, and completed the present invention for efficient reuse of the porous porphyrin polymer that can selectively adsorb precious metals and for high utilization of selectively separated precious metals.

SUMMARY OF THE INVENTION

It is an object of the present invention to provide an electroless plating solution for recovering a precious metal selectively adsorbed on a porous porphyrin polymer.

It is another object of the present invention to provide an economically excellent electroless plating method for recovering a precious metal selectively adsorbed on a porous porphyrin polymer at excellent reduction efficiency.

In accordance with one aspect of the present invention, the above and other objects can be accomplished by the provision of an electroless plating solution containing: a porphyrin polymer represented by Formula 1, on which a precious metal is adsorbed; and an electrolyte solution in which at least one base electrolyte selected from the group consisting of thiourea, sulfite and thiosulfate is dissolved in a solvent, to desorb the precious metal.

[Formula 1]

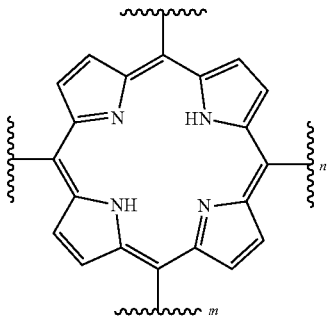

Wherein n is an integer of 5,000 to 50,000, and m is an integer of 5,000 to 50,000.

In accordance with another aspect of the present invention, provided is an electroless plating method including plating a substrate by treating the substrate with the electroless plating solution.

BEST MODE FOR CARRYING OUT THE INVENTION

Figure 1:
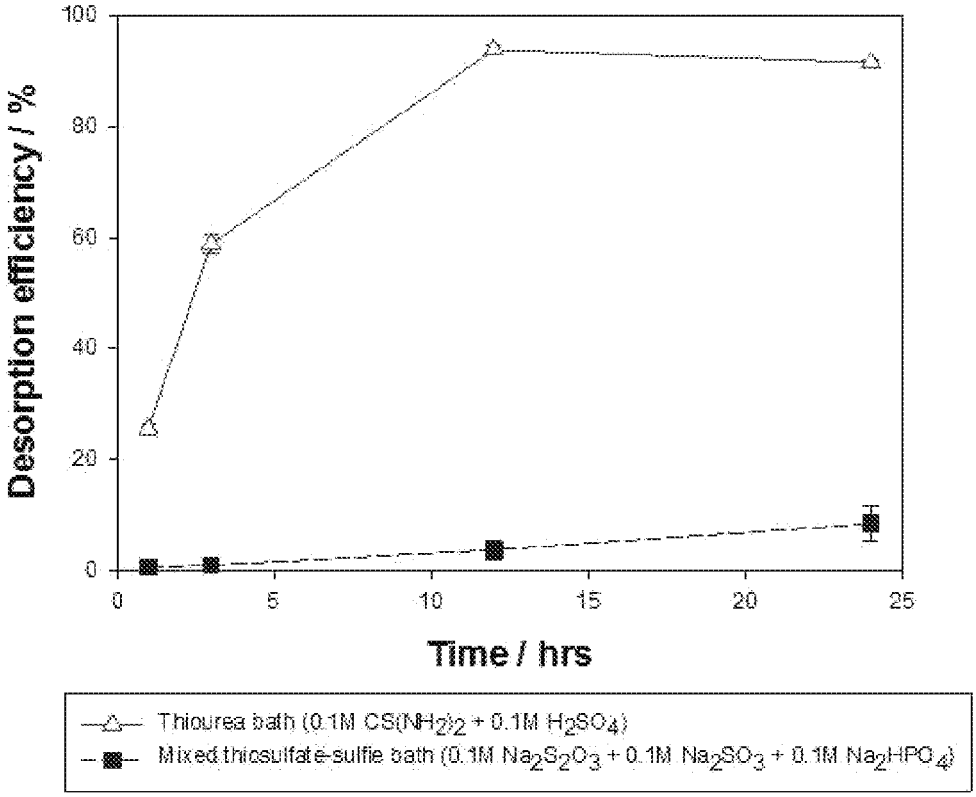
FIG. 1 is a graph showing a desorption efficiency of a precious metal using a non-cyanide leachate from a porous porphyrin polymer, on which the precious metal is selectively adsorbed, according to an embodiment of the present invention.

Unless defined otherwise, all technical and scientific terms used herein have the same meanings as appreciated by those skilled in the field to which the present invention pertains. In general, the nomenclature used herein is well-known in the art and is ordinarily used.

Unless defined otherwise, all technical and scientific terms used herein have the same meanings as appreciated by those skilled in the field to which the present invention pertains. In general, the nomenclature used herein is well-known in the art and is ordinarily used.

In the present invention, it was found that, when an electrolyte containing a porous porphyrin polymer of Formula 1 capable of selectively adsorbing precious metals is used for an electroless plating method, the precious metals selectively adsorbed on the polymer can be recovered at an improved reduction efficiency using a non-cyanide bath without adding highly toxic cyanide as well as an additional desorption oxidizing agent and plating reducing agent, and the polymer can be reused even after desorption of the precious metals.

In one aspect, the present invention is directed to an electroless plating solution containing: a porphyrin polymer represented by Formula 1, on which a precious metal is adsorbed; and an electrolyte solution in which at least one base electrolyte selected from the group consisting of thiourea, sulfite, and thiosulfate is dissolved in a solvent, to desorb the precious metal:

[Formula 1]

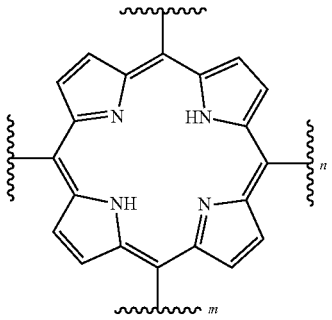

wherein n is an integer of 5,000 to 50,000, and m is an integer of 5,000 to 50,000.

Formula 1 is preferably Formula 1-1.

[Formula 1-1]

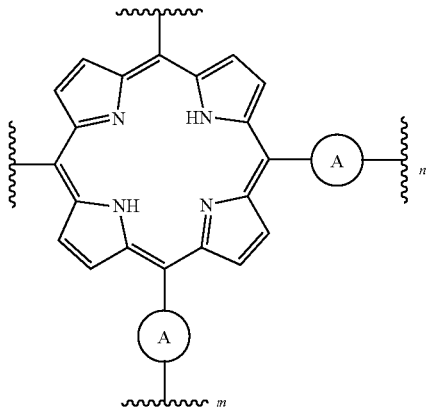

wherein n is an integer of 5,000 to 50,000, m is an integer of 5,000 to 50,000, and

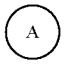

is any chemical linker connecting porphyrin and is preferably selected from the group consisting of phenazine, azo, amide, benzamide and triazine, and the phenazine, azo, amide, benzamide and triazine are represented by Formulas 3 to 7, respectively.

[Formula 3]

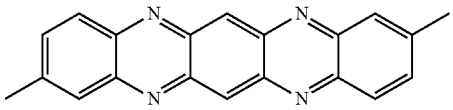

[Formula 4]

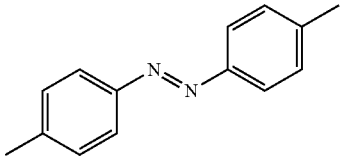

[Formula 5]

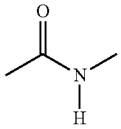

[Formula 6]

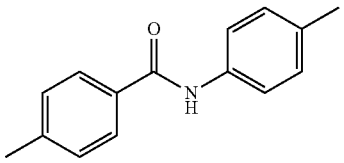

-continued

[Formula 7]

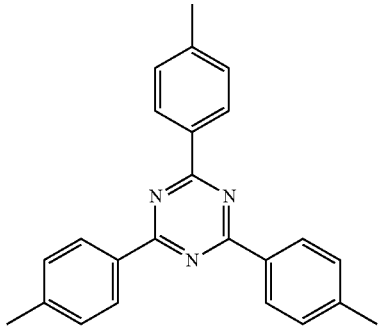

The porphyrin polymer according to the present invention may be represented by the following Formula 2:

[Formula 2]

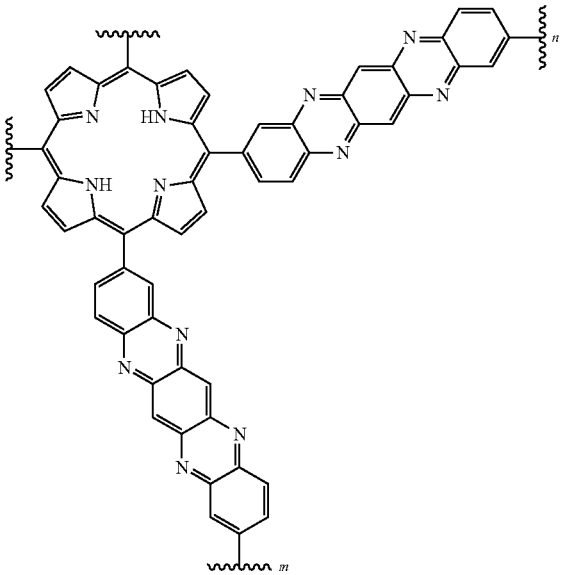

wherein n is an integer of 5,000 to 50,000, and m is an integer of 5,000 to 50,000.

The porphyrin polymer according to the present invention may have a specific surface area of 300 to 1000 $m^2$ $g^{-1}$ and a pore size of 0 to 20 nm.

The porphyrin polymer according to the present invention may be stable at 330° C. or less in air and nitrogen atmosphere and thus may have thermal durability.

The porphyrin polymer of Formula 1 according to the present invention may be prepared by polymerizing a 5,10,15,20-tetrakis(4-nitrophenyl)-21H,23H-porphyrin monomer.

The 5,10,15,20-tetrakis(4-nitrophenyl)-21H,23H-porphyrin monomer may be obtained by dissolving 4-nitrobenzaldehyde in propionic acid and then reacting the resulting solution with acetic anhydride and pyrrole.

The porphyrin polymer may be obtained by mixing and reacting the 5,10,15,20-tetrakis(4-nitrophenyl)-21H,23H-porphyrin monomer, p-phenylenediamine and a base with anhydrous N,N-dimethylformamide, and filtering and drying the precipitate obtained by adding water to the reaction product.

In the present invention, the electrolyte solution used as a leachate to desorb the precious metal element selectively adsorbed on the porous porphyrin polymer may further contain a buffer solution of potassium phosphate ($K_2HPO_4$) or sodium phosphate ($Na_2HPO_4$), and/or at least one acidic solution selected from the group consisting of sulfuric acid ($H_2SO_4$), hydrochloric acid (HCl) and nitric acid ($HNO_3$).

The ionic precious metal adsorbed on the porous porphyrin polymer is leached by being bound to a ligand of the electrolyte in the leachate. The electrolyte solution may contain at least one electrolyte (at a concentration of about 0.01 to 0.5M) of sodium sulfite ($Na_2SO_3$), sodium thiosulfate ($Na_2S_2O_3$) or thiourea ($CS(NH_2)_2$) in water as a solvent and the leachate may further contain at least one buffer of potassium phosphate ($K_2HPO_4$) or sodium phosphate ($Na_2HPO_4$), and/or at least one acidic solution of sulfuric acid ($H_2SO_4$), hydrochloric acid (HCl) or nitric acid ($HNO_3$).

In the present invention, the ligand bound to the precious metal may be a sulfite ion ($SO_3^{2-}$), a thiosulfate ion ($S_2O_3^{2-}$), a thiosulfate-sulfite ion ($(SO_3)(S_2O_3)^{5-}$), or thiourea ($CS(NH_2)_2$).

In the present invention, the precious metal may be selected from the group consisting of gold (Au), platinum (Pt), silver (Ag), palladium (Pd), ruthenium (Ru), rhodium (Rh), iridium (Ir), copper (Cu), and rhenium (Re).

In another aspect, the present invention is directed to an electroless plating method including plating a substrate by treating the substrate with the electroless plating solution.

The electroless plating method for recovering precious metals selectively adsorbed on the porous porphyrin polymer uses a non-cyanide bath containing no cyanide as an electrolyte for metal desorption and plating, a porous porphyrin polymer, on which precious metals dispersed in the electrolyte are adsorbed, and a substrate on which plating occurs.

In the present invention, the plating may be performed at a temperature from room temperature to 80° C.

The substrate may include at least one selected from the group consisting of nickel (Ni), cobalt (Co), cadmium (Cd), chromium (Cr), iron (Fe), zinc (Zn), aluminum (Al), magnesium (Mg), and lithium (Li).

In the present invention, the porphyrin polymer from which the precious metal is desorbed can be reused.

FIG. 1 is a graph showing a recovery efficiency of a precious metal selectively adsorbed on the porous porphyrin polymer through desorption using thiourea or a thiosulfate-sulfite mixture as a leachate according to an embodiment. Each of the thiourea and thiosulfate-sulfite mixture contains an acidic solution and a buffer solution to secure the safety of the electrolyte in the leachate. The process of desorbing precious metals from the porous porphyrin polymer can exhibit a high desorption efficiency without a strong oxidizing agent required for conventional metal leaching, and can exhibit a high recovery efficiency without adding a plating reducing agent, thus being economically effective.

The leachate containing precious metal ions desorbed from the porous porphyrin polymer is directly provided as a plating electrolyte.

Figure 2:
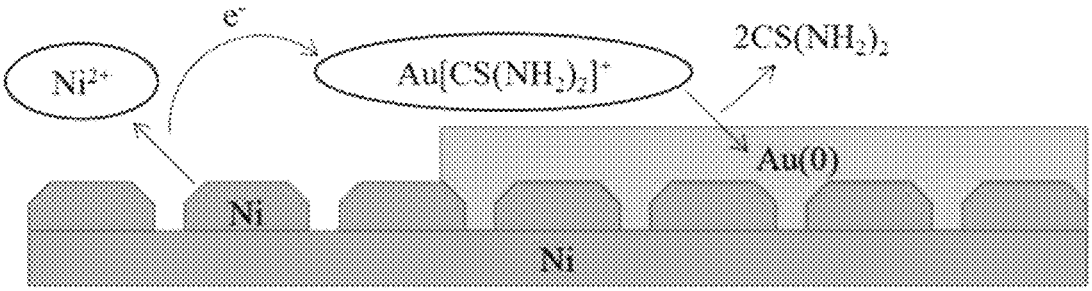
FIG. 2 shows electroless plating a substrate surface with a precious metal contained in a leachate according to an embodiment of the present invention.

FIG. 2 shows electroless plating through reduction of a precious metal on a substrate surface according to an embodiment.

Precious metal ions present in a form bound to ligands are reduced to precious metals when accepting electrons (e) from the substrate surface, and are deposited on the substrate surface and are thus recovered in the form of a film. In this case, the precious metal ions in the electrolyte can be reduced and deposited on the substrate surface by providing electrons during the process of oxidizing the substrate metal on the substrate surface. In addition, efficient reduction of precious metals occurs without a reducing agent required for conventional electroless plating, and thus economic efficiency can be excellent.

Therefore, the substrate metal may include a metal having a great reducing power depending on the redox potential, including, but not limited to, nickel (Ni), cobalt (Co), cadmium (Cd), chromium (Cr), iron (Fe), zinc (Zn), and aluminum. (Al), magnesium (Mg) and lithium (Li).

Figure 3:
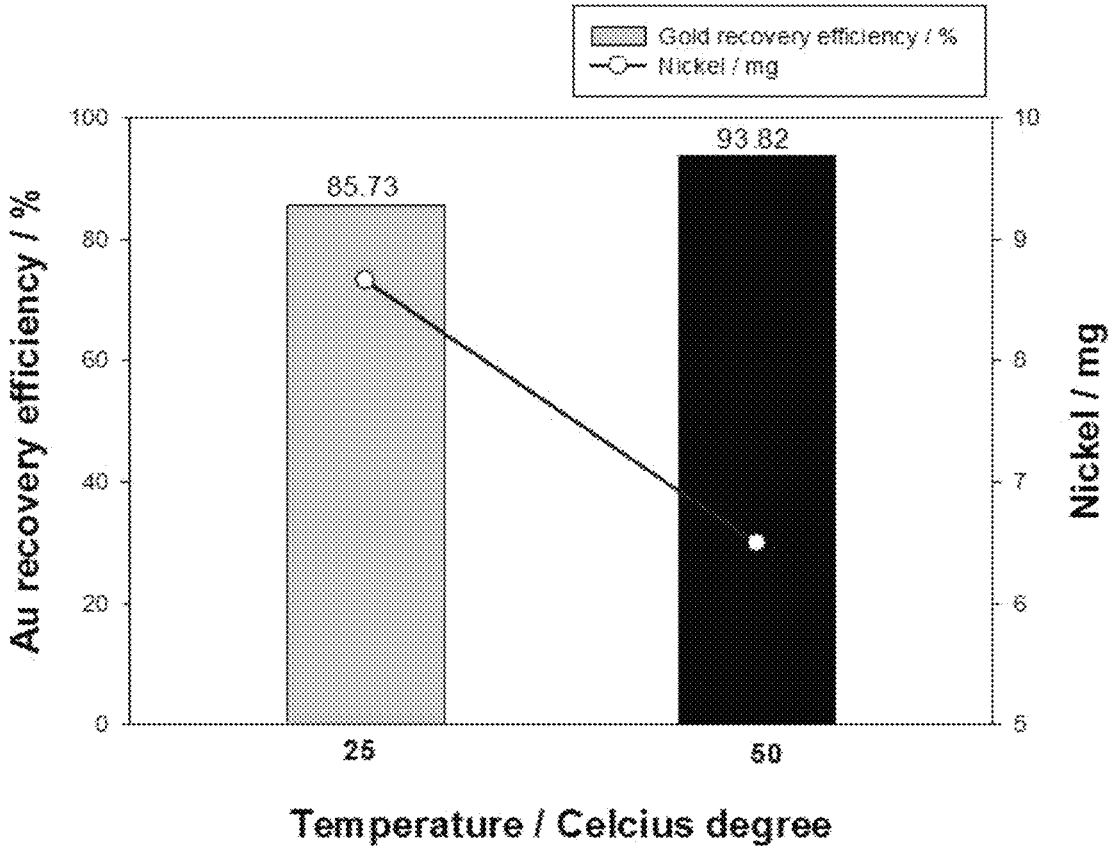
FIG. 3 is a graph showing recovery efficiency of the precious metal depending on temperature using the electroless plating method according to an embodiment of the present invention.
Figure 4:
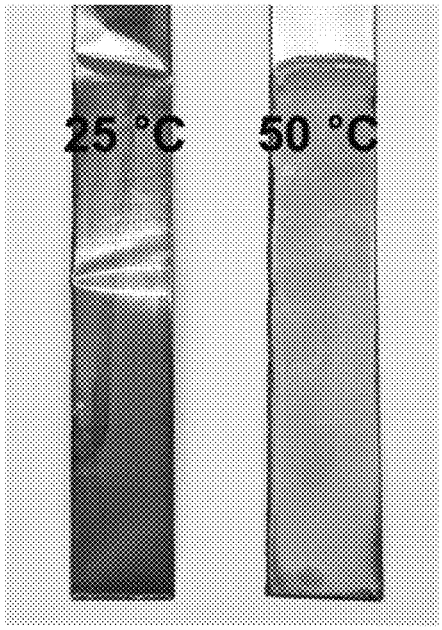
FIG. 4 shows a precious metal recovered by being reduced in the form of a film on the substrate surface in the embodiment of FIG. 3 according to the present invention.

Referring to FIGS. 3 and 4, in the electroless plating method according to the present invention, the temperature may be adjusted within the range from room temperature to 80° C.

The present invention has excellent usability and economic efficiency by applying an electroless plating solution containing a porphyrin polymer represented by Formula 1, on which a precious metal is adsorbed, and a leachate for desorbing the precious metal, to an electroless plating method, and then recovering and regenerating the porous porphyrin polymer.

Figure 5:
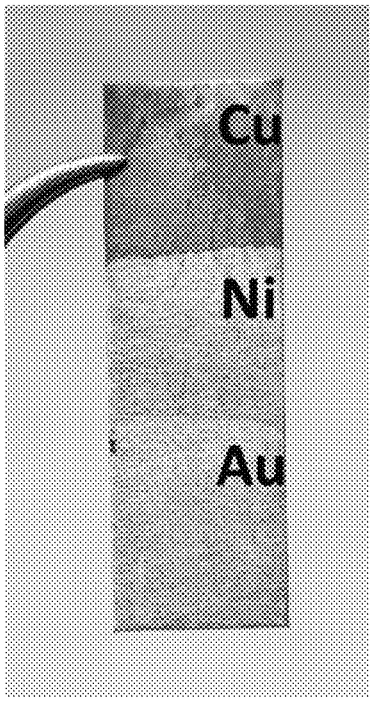
FIG. 5 shows a precious metal recovered by being reduced in the form of a film on the substrate surface by an ENIG (electroless nickel/immersion gold) method according to another embodiment of the present invention.

As can be seen from FIG. 5, the electroless plating method according to the present invention is applicable to an electroless nickel/immersion gold (ENIG) method and is useful for the electronic packaging industry.

Hereinafter, the present invention will be described in more detail with reference to examples. However, it will be obvious to those skilled in the art that these examples are provided only for illustration of the present invention and should not be construed as limiting the scope of the present invention.

EXAMPLE

Preparation Example 1: Synthesis of Porous Porphyrin Polymer

The porous porphyrin polymer is prepared through a two-step reaction including (a) preparing 10,15,20-tetrakis (4-nitrophenyl)-21H,23H-porphyrin, which is a monomer of the polymer, and (b) synthesizing a porous polymer from the 10,15,20-tetrakis(4-nitrophenyl)-21H,23H-porphyrin.

Preparation of 5,10,15,20-tetrakis(4-nitrophenyl)-21H,23H-porphyrin (Hereinafter, Referred to as "TNPPH2")

Monomer TNPPH2 was prepared by slightly modifying the synthetic method reported in the literature (Bettelheim, A., et al., *Inorganic Chemistry* 26.7 (1987): 1009-1017; Yuasa, Makoto, et al., *Journal of the American Chemical Society* 126.36 (2004): 11128-11129).

11.0 g of 4-nitrobenzaldehyde was dissolved in 300 mL of propionic acid, and 12.0 mL of acetic anhydride was added to the solution. The temperature was elevated to a point at which the solution was refluxed, and 5.0 mL of pyrrole was slowly added to solution. The resulting mixture was further reacted at a reflux temperature for 30 minutes and then allowed to cool to room temperature. The solid product was separated by filtration from the solution, dried at room temperature, and then dried in a vacuum oven at 120° C. The dried solid product was added to 120 mL of a pyridine solution, and the mixture was boiled at a reflux temperature while stirring. After 1 hour, the mixture was allowed to cool to room temperature, and the precipitate was filtered and washed with acetone until the solution did not appear dark. The obtained purple product was dried at room temperature and then dried in a vacuum oven at 100° C.

Preparation of Porous Porphyrin Polymer 1 g of TNPPH2, 275 mg of p-phenylenediamine and 710 mg of potassium hydroxide were added to 200 mL of anhydrous N,N-dimethylformamide. The mixed solution was stirred under a nitrogen atmosphere for 1 hour. The temperature of the mixed solution was raised to 150° C. and the reaction was allowed to proceed under a nitrogen atmosphere for 24 hours. After the reaction, 1 L of water was added thereto when the temperature of the mixture reached room temperature. The mixture was stirred for 1 hour and then the precipitate was filtered and dried. The obtained black precipitate was purified with each of N,N-dimethylformamide and water by soxhlet extraction for 1 day. The final product was dried in a vacuum oven at 150° C. The product was obtained as a black powder with a yield of about 75.85%.

Example 1

The porous porphyrin polymer used herein was a polymer containing phenazine (Preparation Example 1), the precious metal adsorbed on the polymer was gold (Au), and the leachates used herein were a 0.1M thiourea ($CS(NH_2)_2$) containing a 0.1M sulfuric acid ($H_2SO_4$) solution and a mixed solution of 0.1M sodium sulfite ($Na_2SO_3$) and 0.1M sodium thiosulfate ($Na_2S_2O_3$) containing 0.1M sodium phosphate ($Na_2HPO_4$) as a buffer solution. 50 mg of a porous porphyrin polymer, on which 21.02% gold was adsorbed, was sprayed into 100 mL of each of thiourea and thiosulfate-sulfite mixture leachates, and the desorption efficiency over time was determined by detecting the gold ion concentration of the leachate. As shown in FIG. 1, when the thiourea leachate containing the acid solution was used, the gold desorption efficiency was 90% or more.

In order to determine the electroless plating efficiency of gold ions desorbed from the porous porphyrin polymer, electroless plating was performed using the gold-thiourea leachate. Nickel was used as a substrate, the reaction area was 10 $cm^2$, and the substrate was reacted with the leachate for 3 hours. As shown in FIG. 3 and FIG. 4, gold in the leachate was reduced on the substrate and recovered in the form of a film, and a recovery efficiency of about 93% was achieved at a reaction temperature of 50° C.

In order to determine the industrial applicability of the electroless plating method, electroless plating was performed using the gold-thiourea leachate using an ENIG (electroless nickel/immersion gold) method. A copper substrate was reacted with a solution containing 25 g/L of nickel sulfate ($NiSO_4.6H_2O$) and 30 g/L sodium hypophosphite ($Na_2H_2PO_2.H_2O$) to obtain a nickel coating film. The nickel-coated copper substrate was immersed in the gold-thiourea leachate at 80° C. to induce an electroless gold plating reaction as shown in FIG. 5.

INDUSTRIAL APPLICABILITY

The present invention has effects of recovering a precious metal selectively adsorbed on a polymer at an improved reduction efficiency using non-cyanide instead of highly toxic cyanide without adding an additional desorption oxidizing agent and a plating reducing agent, and of reusing the polymer even after desorption of the precious metal.

In addition, the present invention is applicable to an ENIG method currently used in the electronic packaging industry and thus has high industrial applicability.

Although the present invention has been described in detail with reference to the specific features, it will be apparent to those skilled in the art that this description is only of a preferred embodiment thereof, and does not limit the scope of the present invention. Thus, the substantial scope of the present invention will be defined by the appended claims and equivalents thereof.

The invention claimed is:

1. An electroless plating solution comprising:

a porphyrin polymer including the repeating groups represented by Formula 1-1, on which a precious metal is adsorbed; and an electrolyte solution in which at least one base electrolyte selected from the group consisting of thiourea, sulfite and thiosulfate is dissolved in a solvent, to desorb the precious metal:

[Formula 1-1]

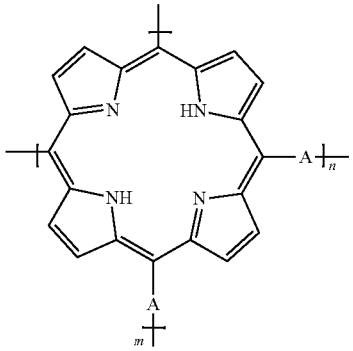

wherein n is an integer of 5,000 to 50,000, m is an integer of 5,000 to 50,000, and A is a linker comprising a functional group selected from the group consisting of phenazine, azo, amide, benzamide and triazine.

2. The electroless plating solution of claim 1, wherein the porphyrin polymer includes the repeating groups represented by Formula 2:

[Formula 2]

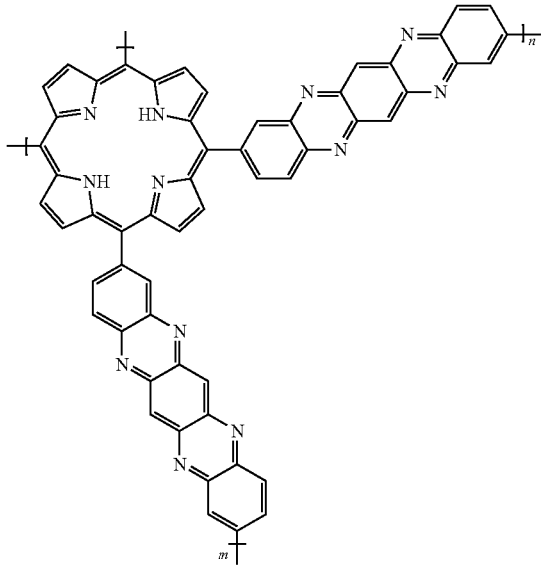

wherein n is an integer of 5,000 to 50,000, and m is an integer of 5,000 to 50,000.

3. The electroless plating solution of claim 1, wherein the electrolyte solution further comprises potassium phosphate ($K_2HPO_4$) or sodium phosphate ($Na_2HPO_4$) as a buffer solution.

4. The electroless plating solution of claim 1, wherein the electrolyte solution further comprises at least one acidic solution selected from the group consisting of sulfuric acid ($H_2SO_4$), hydrochloric acid (HCl) and nitric acid ($HNO_3$).

5. The electroless plating solution of claim 1, wherein the precious metal is selected from the group consisting of gold (Au), platinum (Pt), silver (Ag), palladium (Pd), ruthenium (Ru), rhodium (Rh), iridium (Ir), copper (Cu) and rhenium (Re).

6. An electroless plating method comprising plating the precious metal by treating a substrate with the electroless plating solution of claim 1.

7. The electroless plating method of claim 6, wherein the plating is performed at a temperature from room temperature to 80° C.

8. The electroless plating method of claim 6, wherein the substrate is at least one metal selected from the group consisting of nickel (Ni), cobalt (Co), cadmium (Cd), chromium (Cr), iron (Fe), zinc (Zn), aluminum (Al), magnesium (Mg) and lithium (Li).

9. The electroless plating method of claim 6, wherein the precious metal is selected from the group consisting of gold (Au), platinum (Pt), silver (Ag), palladium (Pd), ruthenium (Ru), rhodium (Rh), iridium (Ir), copper (Cu) and rhenium (Re).

* * * * *